United States Patent [19]

Bantien

[11] Patent Number: 4,564,329

[45] Date of Patent: Jan. 14, 1986

[54] APPARATUS FOR MANIPULATING EMPTY AND FILLED TRAYS FOR CIGARETTES OR THE LIKE BETWEEN MAKING AND PROCESSING MACHINES

[75] Inventor: Jürgen Bantien, Hamwarde, Fed. Rep. of Germany

[73] Assignee: Hauni-Werke Körber & Co. KG, Hamburg, Fed. Rep. of Germany

[21] Appl. No.: 425,514

[22] Filed: Sep. 28, 1982

[30] Foreign Application Priority Data

Jun. 1, 1982 [DE] Fed. Rep. of Germany ..... 3220588

[51] Int. Cl.[4] ..... A24C 5/352

[52] U.S. Cl. ..... 414/403; 198/347; 198/474.1

[58] Field of Search ..... 131/282, 283; 53/148, 53/236; 198/478, 480, 437; 414/403

[56] References Cited

U.S. PATENT DOCUMENTS

| | | | |
|---|---|---|---|
| 3,175,702 | 3/1965 | Banyas | 198/480 |
| 3,460,191 | 8/1969 | Felstehausen | 198/480 |
| 3,563,377 | 2/1971 | Southcott | 198/480 |
| 3,591,026 | 7/1971 | Felstehausen | 198/478 |
| 4,449,625 | 5/1984 | Grieben et al. | 198/478 |

FOREIGN PATENT DOCUMENTS

| | | | |
|---|---|---|---|
| 161721 | 12/1980 | Japan | 198/478 |

*Primary Examiner*—V. Millin
*Assistant Examiner*—H. Macey
*Attorney, Agent, or Firm*—Peter K. Kontler

[57] ABSTRACT

Apparatus for directly coupling a cigarette maker with a packing machine has a tray filling unit which stores empty trays at an upper level and filled trays at a lower level and receives cigarettes from the maker, a tray evacuating unit which stores empty trays at an upper level and filled trays at a lower level and evacuates the contents of filled trays by simultaneously changing the orientation of cigarettes by 180°, and a connecting system which delivers empty trays from the evacuating unit to the filling unit and delivers filled trays from the filling unit to the evacuating unit by simultaneously changing the orientation of the trays so as to compensate for changes in orientation during evacuation of cigarettes from the trays. The connecting system employs one or more upright rotary turrets with tray carriers at two levels and a motor which indexes the turret or turrets and the respective tray carriers through 90° or 180°. A magazine for temporary storage of empty trays at a higher level and for temporary storage of filled trays at a lower level is movable incrementally along the connecting system.

25 Claims, 10 Drawing Figures

I
Ea
Eb
9E
37b
41
42
43
41
37
4
36
44
37a
38
39
38
12'

I
Ea
Eb
11E
49
4
12A'
51
48
46
47

APPARATUS FOR MANIPULATING EMPTY AND FILLED TRAYS FOR CIGARETTES OR THE LIKE BETWEEN MAKING AND PROCESSING MACHINES

CROSS-REFERENCE TO RELATED CASES

An apparatus which is somewhat related to the apparatus of the present invention is disclosed in the commonly owned copending patent application Ser. No. 420 895 filed Sept. 21, 1982 abandoned by Rolf Gömann et al. for "Apparatus for transporting and changing the orientation of cigarettes or the like". Apparatus for transporting trays for cigarettes or the like between different levels are disclosed in commonly owned copending patent application Ser. No. 304,266 filed Sept. 21, 1981 by Karl-Heinz Grieben et al. for "Apparatus for transporting trays for cigarettes or the like" now U.S. Pat. No. 4,449,625 granted May 22, 1984. An apparatus which can introduce cigarettes of a mass flow into successive trays is disclosed in commonly owned patent application Ser. No. 368,261 filed Apr. 14, 1982 by Horst Baese et al. for "Method and apparatus for transporting cigarettes or the like between producing and processing machines". Commonly owned copending patent application Ser. No. 368,312 of Horst Baese et al., filed Apr. 14, 1982, discloses an "Apparatus for transporting cigarettes or the like between producing and consuming machines". Commonly owned U.S. Pat. Nos. 3,308,600 (granted Mar. 14, 1967 to Otto Erdmann et al.), 3,190,459 (granted June 22, 1965 to Horst Kochalski et al.), 3,236,356 (granted Feb. 22, 1966 to Horst Kochalski et al.), 3,245,558 (granted Apr. 12, 1966 to Horst Kochalski et al.), 3,481,447 (granted Dec. 2, 1969 to Horst Kochalski et al.), 3,519,143 (granted July 7, 1970 to Horst Kochalski et al.) and 3,662,880 (granted May 16, 1972 to Horst Kochalski et al.) disclose apparatus for introduction of cigarettes into trays and mobile magazines for temporary storage of trays therein. The disclosures of the above-enumerated patent applications and patents are incorporated herein by reference.

BACKGROUND OF THE INVENTION

The present invention relates to apparatus for manipulating receptacles, especially to improvements in apparatus for manipulating so-called chargers or trays which are used for temporary storage of rod-shaped articles forming part of or constituting smokers' products. More particularly, the invention relates to improvements in apparatus for establishing a connection between a maker of rod-shaped articles (hereinafter called cigarettes) and a machine which processes or consumes such articles. Typical examples of makers are cigarette rod making or filter tipping machines, and typical examples of processing machines are filter tipping machines (if the maker is a cigarette making machine) and packing machines (if the maker is a cigarette making machine or a filter tipping machine). Trays or chargers are also used for temporary storage and curing of filter rod sections. All in all, rod-shaped articles which can be temporarily stored in chargers or trays can constitute plain or filter cigarettes, cigars, cigarillos, cheroots or filter rod sections.

Problems arise when the articles which are stored in trays or chargers (hereinafter called trays for short) are axially non-symmetrical. An example of an axially non-symmetrical article is a filter cigarette which has a filter mouthpiece at one of its axial ends. Another example of an axially non-symmetrical article is a plain or filter cigarette which carries an imprint (such as the brand name of the manufacturer, the name of the manufacturer, the trademark and/or a combination of these) nearer to the one than to the other end or where the imprint is not composed of two halves which are mirror symmetrical to each other with reference to a plane halving the article and extending at right angles to the longitudinal axis of the article. If the articles are axially non-symmetrical, they must be oriented in a certain way so that all filters of filter cigarettes, cigars or cigarillos face in the same direction prior to introduction into packs or other types of receptacles, and that the orientation of printed matter on each of a long series of articles will be the same.

Direct coupling of makers with processing machines is becoming increasingly popular in many types of industries including the plants for the production and processing of rod-shaped smokers' products. For example, it is already known to establish a mass flow of cigarettes between a filter tipping and a packing machine so that the magazine of the packing machine can receive the output of the filter tipping machine without the interposition of any intermediate stations. If the output of the tipping machine exceeds the requirements of the packing machine, the surplus of the output must be temporarily stored at so-called buffer stations, e.g., in reservoirs of the type known as through-flow reservoirs or first in-first out reservoirs, or in reservoirs of the type known as surge bins (first-in last-out reservoirs). It is also known to resort to buffer stations or magazines which employ chargers or trays. Such buffer stations must be provided with a tray filling unit which accepts the surplus of the output of a maker and stores the thus accepted surplus in trays, and a tray evacuating unit which accepts filled trays from the filling unit, which delivers empty trays to the filling unit, and which supplies cigarettes to the processing machine when the output of the maker is too low.

As a rule, the tray evacuating unit is constructed and assembled in such a way that it changes the orientation of cigarettes or other rod-shaped articles by 180 degrees. This means that, if the articles are axially non-symmetrical, it is necessary to turn each article end-for-end prior to admission into the processing machine because, in the absence of such tip-turning, the articles which are received from the trays are oriented in a first way whereas the articles which arrive directly from the maker are oriented in a different second way. Filled trays are normally turned along one of their longer edges so that the orientation of the tray during evacuation of its contents is changed by 180 degrees with reference to the orientation during filling. Therefore, heretofore known magazines which employ trays are designed in such a way that each filled tray is inverted by hand prior to evacuation of its contents. It is evident that such manual handling of filled trays slows down the entire operation and contributes significantly to the cost. Moreover, manual handling of trays prevents full automation of the tray manipulating operation and renders the entire plant overly dependent on the skill and/or conscientiousness of the attendants.

OBJECTS AND SUMMARY OF THE INVENTION

An object of the invention is to provide a novel and improved apparatus which can manipulate trays or analogous receptacles between a maker and a processing machine without any manual handling of the trays.

Another object of the invention is to provide a novel and improved direct connection between a maker and a processing machine for cigarettes or analogous rod-shaped articles of the tobacco processing industry.

A further object of the invention is to provide an apparatus which can properly orient all articles reaching the processing machine even if the articles are axially non-symmetrical and even if some or all of the articles must be inverted or otherwise reoriented during transport between the maker and the processing machine.

An additional object of the invention is to provide the apparatus with novel and improved means for manipulating cigarette trays or analogous receptacles for rod-shaped smokers' products.

Another object of the invention is to provide the apparatus with novel and improved means for temporarily storing filled and/or empty trays for cigarettes or the like.

An additional object of the invention is to provide the apparatus with novel and improved means for changing the orientation of trays for cigarettes or the like between the maker of and the processing machine for such articles.

Still another object of the invention is to provide a novel and improved method of manipulating trays for cigarettes or the like in a small area, with a minimum of control, without the need for manual intervention, and at the rate at which such trays are filled with articles issuing from modern high-speed making machines.

A further object of the invention is to provide an apparatus which can be readily installed between and which can establish a direct or indirect connection from a maker to a processing machine, such as a cigarette maker and a packing machine for cigarettes.

Another object of the invention is to provide the apparatus with novel and improved means for classifying the trays according to their contents, i.e., whether the trays are empty, filled or partially filled with rod-shaped articles.

The invention resides in the provision of an apparatus for manipulating receptacles (hereinafter called trays) for rod-shaped articles of the tobacco processing industry (hereinafter called cigarettes). The apparatus comprises a first multi-level unit for filling of the trays, a second multilevel unit for evacuating cigarettes from filled trays, and means for connecting the two units with one another. The connecting means comprises at least one rotary orientation changing device (e.g., in the form of a rotary turret) which includes at least one tray carrier at each level of the first or second unit. Each of the carriers is designed to removably support a tray, and the carriers are indexible about a common substantially vertical axis. In accordance with a presently preferred embodiment of the invention, each of the two units includes two storeys or levels. The aforementioned orientation changing device of the connecting means further comprises means for indexing the tray carriers through angles of n times 90° wherein n is a whole number including one (as a rule, the carriers will be indexed through angles of 90° or 180°).

The apparatus preferably further comprises a mobile magazine (e.g., a wagon or another suitable wheel-mounted conveyance) which is adjacent to the orientation changing device and serves to accept trays from as well as to supply trays to the orientation changing device (hereinafter called turret for short). Means can be provided for moving the magazine stepwise through increments of predetermined length, preferably corresponding to a selected dimension (e.g., thickness) of a tray.

The turret can comprise pairs of tray carriers, one pair for each level of the first or second unit, and the carriers of each pair are then angularly offset by 180° with reference to each other. Each unit can comprise an upper and a lower level, a first platform (e.g., one or more endless belt or chain conveyors) disposed at the upper level and arranged to support empty trays, and a second platform disposed at the lower level and arranged to support filled trays. The magazine is also preferably provided with an upper platform for temporary storage of empty trays and a lower platform for temporary storage of filled trays.

The turret can comprise an upright rotor and means for pivotally mounting the carriers on the rotor. Such mounting means preferably defines for the carriers substantially horizontal pivot axes which are disposed at least substantially tangentially of the rotor. Still further, the turret can comprise an upright column or shaft which rotatably supports the rotor, and means for pivoting the carriers with reference to the rotor. Such pivoting means can comprise a linkage for each of the carriers and means for moving the linkages with reference to the column to thereby pivot the carriers relative to the rotor.

The trays are normally of the type having two relatively wide substantially upright first sides and two relatively narrow substantially upright second sides which alternate with the first sides. In accordance with a presently preferred embodiment of the invention, the apparatus further comprises means for transferring trays between one of the units (e.g., the first multi-lever unit) and the turret by moving the trays at right angles to their first sides, means for transferring trays between the magazine and the turret by moving the trays at right angles to their second sides, and means for transferring trays between the turret and the other unit by moving the trays at right angles to their second sides.

Alternatively, the apparatus can be constructed and assembled in such a way that it comprises means for transferring trays between the turret on the one hand and the two units and the magazine on the other hand by moving the trays at right angles to the second sides. In such apparatus, the turret can be disposed between the two units.

The connecting means can comprise the aforementioned (first) turret with two tray carriers at each level, and a second turret with one carrier at each level. The first turret is then adjacent to one of the units (e.g., to the first unit) and the second turret is then disposed between the first turret and the other unit. In such apparatus, the magazine is preferably designed to store trays in a first orientation and the two units include means for storing trays in a different second orientation (normally at right angles to the trays in the magazine). The magazine is then preferably movable at right angles to the direction of movement of trays in the two units.

The novel features which are considered as characteristic of the invention are set forth in particular in the appended claims. The improved apparatus itself, however, both as to its construction and its mode of operation, together with additional features and advantages thereof, will be best understood upon persual of the following detailed description of certain specific embodiments with reference to the accompanying drawing.

DESCRIPTION OF THE PREFERRED EMBODIMENTS

Figure 9:
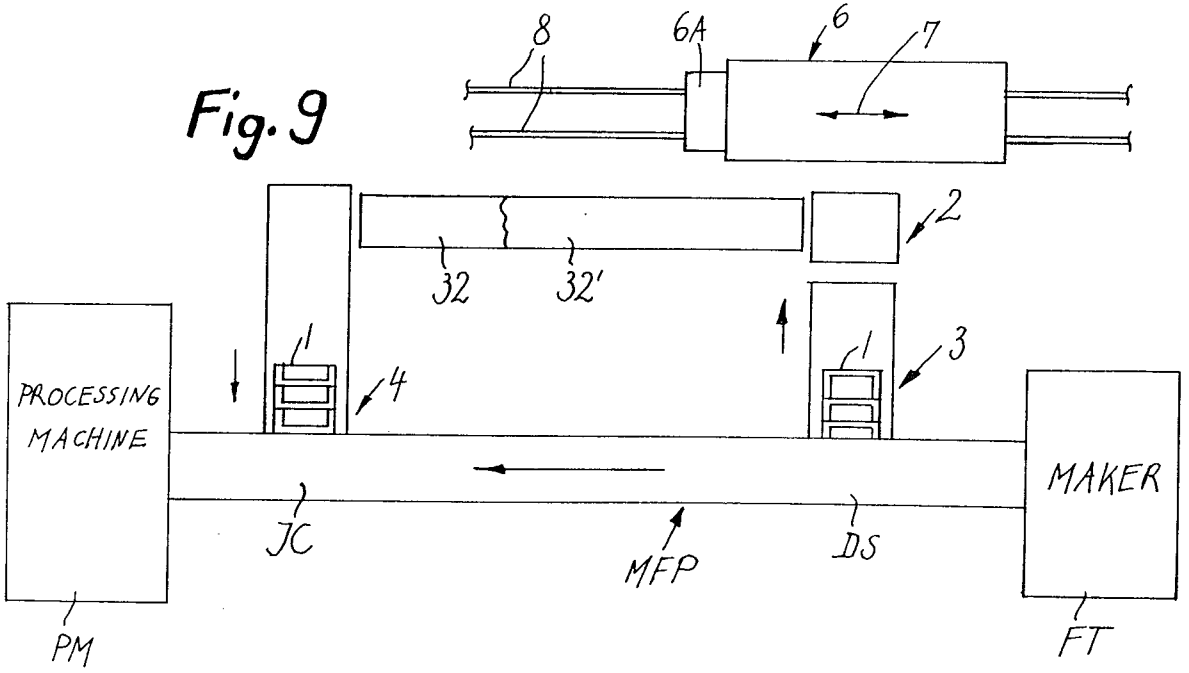
FIG. 9 is a schematic plan view of a production line having a maker and a processing machine and embodying the apparatus of FIGS. 1 to 6*b*.

The apparatus of the present invention is designed to directly couple a cigarette making machine (e.g., a machine of the type known as GARANT or SE 80 (each of which is manufactured and sold by the assignee of the present application) or a filter tipping machine FT (such as MAX-S which is manufactured and sold by the assignee of the present application) with one or more processing machines PM (e.g., a packing machine known as COMPAS which is manufactured and sold of the assignee of the present application). Reference may be had to FIG. 9 which further shows a conveyor system MFP defining a path for a multi-layer mass flow or stream of filter cigarettes from the maker FT to the processing machine PM. The apparatus comprises a tray filling unit 3 wherein successive receptacles in the form of empty chargers or trays 1 can be filled with stacks of plain or filter cigarettes issuing from the maker FT, a tray evacuating unit 4 wherein filled trays are converted into empty trays by discharging their contents into the magazine of the processing machine PM or onto the conveyor system MFP, and a connecting means including a device 2 which can change the orientation of trays and which, in the embodiment of FIGS. 1 and 2, constitutes a rotary two-story or two-level turret the details of which can be seen in FIG. 1. The tray filling unit 3 may be a so-called mass flow tray filler of the type known as HCF (manufactured and sold by the assignee of the present application) which diverts the mass flow of cigarettes issuing from the maker FT into successive empty trays 1. The tray evacuating unit 4 may be of the type known as Magomat which is manufactured and sold by the assignee of the present application and which reconverts the contents of successively delivered filled trays into a mass flow for introduction of successive increments of the mass flow into the processing machine PM. If the maker is a cigarette making machine, the processing machine can constitute a packer or a filter tipping machine. On the other hand, if the maker is a filter tipping machine FT, the processing machine PM is normally a packer.

Figure 3:
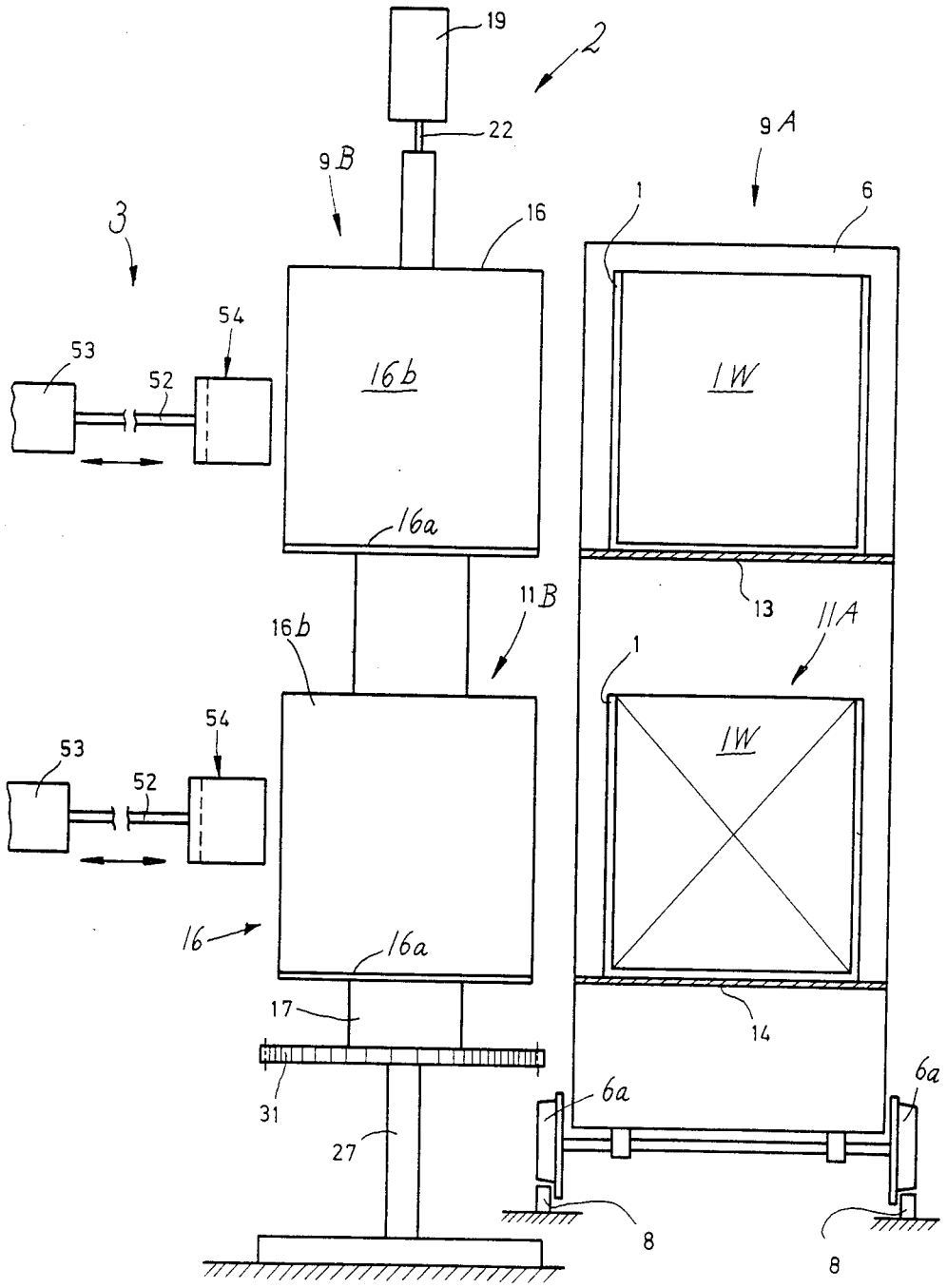
FIG. 3 is a partly elevational and partly vertical sectional view, substantially as seen in the direction of arrows from the line III—III of FIG. 2.

In order to enhance the flexibility of the illustrated apparatus, the latter preferably further comprises a mobile magazine B 6 for temporary storage of filled and empty trays; the illustrated magazine 6 is a wheel-mounted conveyance in the form of a so-called tray wagon which is reciprocable in directions indicated by a double-headed arrow 7 and is preferably mounted on rails 8 which can be seen in FIG. 9 and in the lower right-hand portion of FIG. 3. The directions of advancement of filled and empty trays 1 in the tray filling unit 3 are respectively indicated by the arrows 7*a* and 7*b;* such directions are normal or substantially normal to the directions of movement of the wagon 6 between the units 3, 4 and along the turret 2. The directions of movement of filled and empty trays in the evacuating unit 4 are respectively indicated by the arrows 7*c* and 7*d;* these directions are parallel to those indicated by the arrows 7*a* and 7*b*.

The drive means 6A for the wheels 6*a* of the wagon 6 is shown in FIG. 9; such drive means is designed to advance the wagon 6 in stepwise fashion, namely, by increments whose length matches the width of a tray 1. To this end, the drive means 6A for the wheels 6*a* can comprise a suitable reversible stepping motor of any known design.

The tray filling unit 3 has two different levels, namely, an upper level 9 (see FIG. 1) for empty trays 1 and a lower level 11 for filled trays. Analogously, the tray evacuating unit 4 comprises an upper level 9E for empty trays 1 and a lower level 11E for filled trays. Still further, the wagon 6 also comprises an upper level 9A (see FIG. 3) for empty trays 1 and a lower level 11A for filled trays.

The means for supporting empty trays 1 at the upper level 9 of the tray filling unit 3 comprises an upper platform including one or more endless belt or chain conveyors 12 which can advance empty trays 1 stepwise in the direction of arrow 7*b*. A similar platform including one or more endless conveyors 12A is provided at the lower level 11 of the tray filling unit 3 to advance filled trays 1 stepwise in the direction of arrow 7*a*. One or more endless conveyors (12′ and 12A′) are provided at each level (9E, 11E) of the tray evacuating unit 4 to respectively advance empty trays 1 (at the upper level 9E) in the direction of arrow 7*d* and to advance filled trays in the direction of arrow 7*c* (at the lower level 11E).

The upper and lower levels of the turret 2 are respectively shown at 9B and 11B (see FIG. 3).

Empty trays 1 which are temporarily stored at the upper level 9A of the wagon 6 rest on a first or upper fixed platform 13, and the filled trays at the lower level 11A of the wagon 6 rest on a second or lower fixedly mounted platform 14, i.e., there is no need to provide endless belt or chain conveyors for transport of empty or filled trays within the confines of the wagon 6 (however, the use of such or other types of conveyors is not excluded).

The turret 2 comprises pivotable tray holders or carriers 16 which are disposed in pairs, one pair at the upper level 9B and the other pair at the lower level 11B. The position of the turret 2 is selected in such a way that it can directly receive filled trays from the lower level 11 of the tray filling unit 3, that it can directly deliver empty trays to the upper level 9 of the tray filling unit 3, that it can directly deliver filled trays to or receive filled trays from the lower level 11A of the wagon 6, that it can directly receive empty trays from or directly deliver empty trays to the upper level 9A of the wagon 6, and that it can indirectly deliver filled trays to and indirectly receive empty trays from the tray evacuating unit 4. It is equally possible to place the turret 2 next to the tray evacuating unit 4, to place the wagon 6 next to the thus shifted turret 2, and to establish indirect connections for transport of filled and empty trays between the tray filling unit 3 and the shifted turret 2.

The carriers 16 of each pair of carriers on the turret 2 are disposed diametrically opposite each other with reference to the vertical axis of rotation of the turret. Each of the carriers 16 can constitute a substantially L-shaped structure having a horizontal or nearly horizontal base 16*a* and a substantially upright back support 16*b* which extends upwardly from the base and is articulately connected to the hollow upright cylindrical rotor 17 of the turret 2. The pivots 18 for the upper portions of the back supports 16*b* are horizontal and extend substantially tangentially of the rotor 17.

The means 21 for pivoting the carriers 16 of each pair of such carriers relative to each other and with reference to the rotor 17 comprises two sets of links 26 whose elements are articulately connected to the respective back supports 16*b* at levels below the corresponding pivots 18 as well as to a vertically movable piston rod 22 which is coaxial with and is installed in the interior of the rotor 17. The joints between the links 26 and the respective back supports 16*b* are shown at 24, and the joints between such links and the piston rod 22 are shown at 23. The arrangement is such that the bases 16*a* of the carriers 16 of each pair of carriers are moved away from each other (the carriers 16 then assume the broken-line positions 16′ shown in FIG. 1) when the piston rod 22 is caused to move vertically downwardly, and that the carriers 16 are pivoted back to their upright positions (indicated in FIG. 1 by solid lines) in response to upward movement of the piston rod 22. The extent of angular movement of the carriers 16 about the axes of the respective horizontal pivots 18 can be in the range of between three and ten degrees. The means for moving the piston rod 22 up and down comprises a double-acting fluid-operated (e.g., pneumatic) cylinder and piston motor 19 which is installed at the top of the turret 2. The means for supplying pressurized fluid to selected cylinder chambers and for permitting fluid to escape from the chambers of the motor 19 is of conventional design and is not shown in the drawing.

The rotor 17 of the turret 2 can turn about the axis of an upright vertical supporting column or shaft 27 on antifriction roller or ball bearings 27*a*. The means for indexing the rotor 17 about the shaft 27 comprises a motor 28 whose output element carries a gear 29 in mesh with a larger-diameter gear 31 at the lower end of the rotor 17 (the gear 31 can constitute an integral part of the rotor). The motor 28 is a stepping motor which can be actuated to index the rotor 17 and the tray carriers 16 through angles of 90 or 180 degrees, i.e., n times 90 degrees wherein n is a whole number including one.

Figure 5:
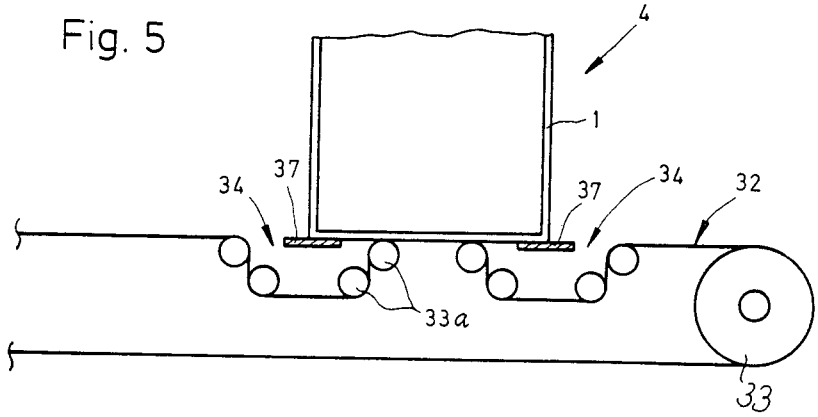
FIG. 5 is an enlarged fragmentary front elevational view as seen in the direction of arrows from the line V—V of FIG. 2.

The means for connecting the tray filling unit 3 with the tray evacuating unit 4 further comprises an upper endless intermediate belt or chain conveyor 32 whose upper reach transports empty trays 1, and a similar or analogous lower endless belt or chain conveyor 32′ whose upper reach transports filled trays. The conveyors 32 and 32′ are trained over suitable pulleys or sprocket wheels 33. As can be seen in FIG. 5, the upper reach of the conveyor 32 is further guided and deflected by additional pulleys or rollers or wheels 33*a* which establish in the upper reach of this conveyor two spaced recesses 34 which provide room for the tray carriers 16 of the turret 2 and/or for tray transferring means for delivery of empty trays from the tray evacuating unit 4 to the conveyor 32 or vice versa. The upper reach of the lower conveyor 32′ is deformed and guided in an analogous manner. The lower conveyor 32′ advances filled trays 1 in the direction of arrow 7*e*, and the upper conveyor 32 advances empty trays in the direction of arrow 7*f*.

Figure 6A:
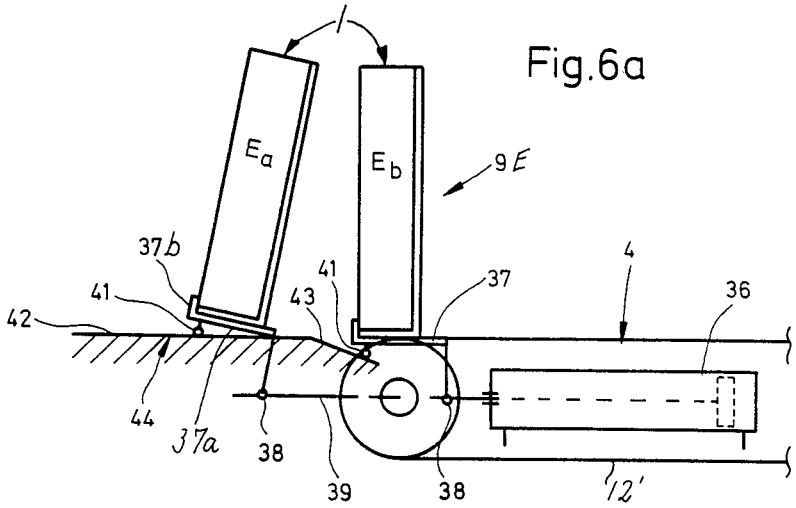
FIG. 6*a* is an enlarged fragmentary end elevational view as seen in the direction of arrows from the line VI—VI of FIG. 2, showing the mechanism which transfers empty trays between the tray evacuating unit and a first intermediate conveyor of the connecting means.

The mechanism for transferring empty trays 1 from the tray evacuating unit 4 onto the upper intermediate conveyor 32 is shown in FIG. 6*a*. This mechanism comprises a two-piece carriage 37 (see also FIG. 5) which is reciprocable by a double-acting cylinder and piston motor 36 and which is shown in FIG. 6*a* in two different positions. The articulate connection (e.g., a pivot) between the piston rod 39 of the double-acting cylinder and piston motor 36 and the carriage 37 is shown at 38. The underside of the carriage 37 is provided with a roller follower 41 which can track a stationary cam 44 having a horizontal cam face 42 and an inclined cam face 43 serving as a means for enabling the carriage 37 to move between the two positions shown in FIG. 6*a*. The carriage 37 comprises a base 37*a* the underside of which is provided with the roller follower 41, and a short upwardly extending abutment 37*b* for the tray 1 on the base 37*a*. The cam 44 guides the carriage 37 during travel toward the locus of deposition of empty trays 1 on the upper reach of the upper endless intermediate belt or chain conveyor 32 which can deliver such tray to the turret 2.

Figure 6B:
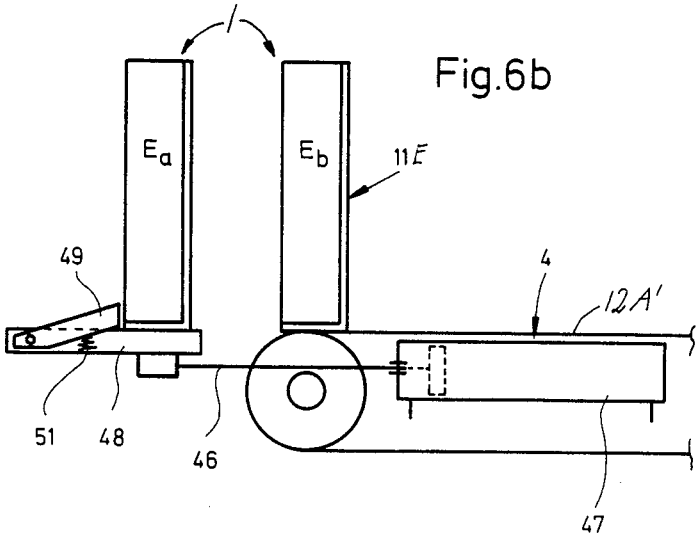
FIG. 6*b* is a similar enlarged fragmentary end elevational view but showing the mechanism which transfers filled trays between the tray evacuating unit and a second intermediate conveyor of the connecting means.

FIG. 6*b* shows the mechanism for transferring filled trays 1 from the lower endless intermediate belt or chain conveyor 32′ onto the lower conveyor 12A′ of the tray evacuating unit 4. This transferring mechanism comprises a fluid-operated (e.g., pneumatically operated) double-acting cylinder and piston motor 47 whose piston rod 46 is coupled to a carriage 48. The carriage 48 is provided with a pivotable pawl 49 which is biased to the illustrated position by a coil spring 51 and is depressible by a filled tray 1 which travels thereover in the direction of arrow 7*c*. The pawl 49 reassumes the illustrated extended position as soon as the filled tray has advanced thereover to take the position shown at Ea. The piston rod 46 is then retracted into the cylinder of the double-acting cylinder and piston motor 47 to thereby transfer the tray from the position Ea to the position Eb, i.e., onto the lower conveyor 12A′ of the tray evacuating unit 4, namely, onto the conveyor which supports filled trays at the lower level 11E of the unit 4. The pawl 49 is also depressible by the upper reach of the intermediate conveyor 32′ which is assumed to carry the filled tray 1 to the position Ea (while the carriage 48 moves in a direction to the left, as viewed in FIG. 6*b*).

Figure 4:
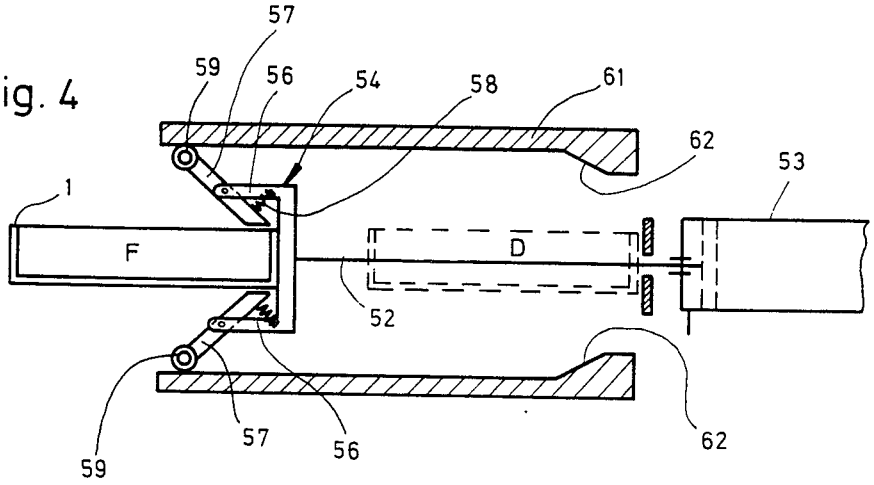
FIG. 4 is an enlarged partly elevational and partly sectional view of a mechanism which serves to transfer empty or filled trays between the turret and the magazine of the apparatus shown in FIGS. 1 to 3.

FIG. 4 shows one of the two mechanisms for transferring trays between the turret 2 and the wagon 6. Each such mechanism can be said to form part of, or to be associated with, the tray filling unit 3 and each such mechanism comprises a pusher 54 which is mounted at the free end of a piston rod 52 forming part of a fluid-operated (e.g., pneumatic) double-acting cylinder and piston motor 53. The pusher 54 can shift trays 1 from the turret 2 onto the wagon 6 by moving in a direction to the left, as viewed in FIG. 4, and such pusher can also serve to pull trays 1 in the opposite direction, namely, from the wagon 6 onto the turret 2. To this end, the pusher 54 has two spaced-apart parallel supporting arms 56 for pivotable two-armed jaws or claws 57 which are biased by coil springs 58 and whose outer end portions carry roller followers 59 tracking two stationary cams 61 having straight cam faces and inclined cam faces provided on the lobes 62. The springs 58 urge the corresponding followers 59 against the respective cams 61. The jaws 57 are caused to move apart and to release a tray 1 which is located therebetween when the roller followers 59 reach and travel along the corresponding lobes 62.

Figure 2:
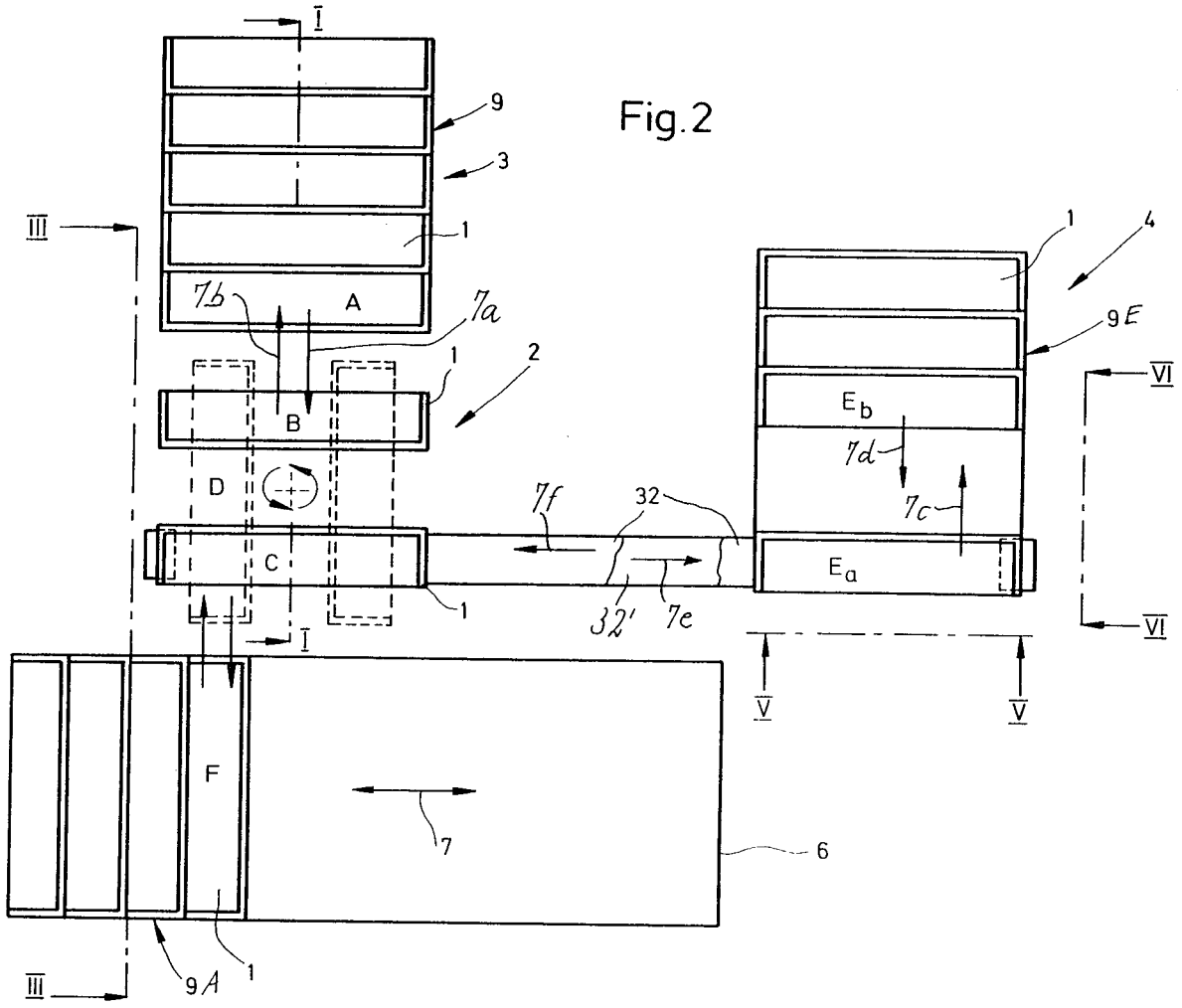
FIG. 2 is a plan view of the apparatus which embodies the structure of FIG. 1.

The mode of operation of the apparatus which is shown in FIGS. 1 to 6*b* is as follows:

With reference to FIG. 2, the character A denotes the position of an empty tray 1 on the conveyor 12 at the upper level 9 of the tray filling unit 3, or the position of a filled tray on the conveyor 12A at the lower level 11 of the unit 3. The character B denotes the position of an empty tray on an upper carrier 16 of the turret 2 (such tray is assumed to have been delivered from the conveyor 12 and is about to be inverted by the rotor 17), of the position of a filled tray on a lower carrier 16 of the turret 2 (such tray is assumed to have been delivered from the lower conveyor 12A and is about to be inverted to assume the position C in response to indexing of the rotor 17 through 180 degrees). The character C denotes in FIG. 2 the position of an empty tray 1 which has been delivered by the upper intermediate conveyor 32 and is supported by one of the upper carriers 16 preparatory to indexing through 180 degrees so that the thus inverted empty tray then assumes the position B, or the position of a filled tray which has been moved to such position in response to indexing of the rotor 17 through 180 degrees and preparatory to advancement of the tray 1 by the conveyor 32′ toward the tray evacuating unit 4. The character D denotes the position of an empty tray 1 which has been indexed by an upper carrier 16 of the turret 2 through 90 degrees and is about to be transferred onto the upper platform 13 of the wagon 6 or the position of an empty tray which has been transferred onto an upper carrier 16 preparatory to turning of the rotor 17 through 90 degrees so as to move the empty tray to the position B (for transfer onto the conveyor 12 at the upper level 9 of the tray filling unit 3). Furthermore, the character D can denote the position of a filled tray 1 on one of the lower carriers 16 subsequent to indexing of the rotor 17 through 90 degrees (to move the filled tray from the position B to the position C preparatory to transfer onto the lower platform 14 of the wagon 6) or the position of a filled tray which has been transferred from the lower platform 14 of the wagon 6 onto one of the lower carriers 16 preparatory to indexing of the rotor 17 through 90 degrees (so as to move the filled tray to the position C in which the filled tray is ready to be taken over by the lower intermediate conveyor 32′ for transport toward the tray evacuating unit 4).

The character Ea denotes the position of an empty tray 1 on the upper intermediate conveyor 32 preparatory to transfer toward the turret 2, or the position of a filled tray on the lower intermediate conveyor 32′ preparatory to transfer into the tray evacuating unit 4. The character Eb denotes the position of an empty tray 1 on the upper conveyor 12′ of the tray evacuating unit 4 or the position of a filled tray on the lower conveyor 12A′ of the unit 4.

The character F denotes the position of an empty tray on the upper platform 13 of the wagon 6, or the position of a filled tray on the lower platform 14 of the wagon.

The characters 1W denote the pairs of relatively wide parallel upright sides of the filled or empty trays 1, and the characters 1N denote pairs of relatively narrow parallel upright second sides of the trays 1. The second sides 1N alternate with the first sides 1W. It will be seen that the trays 1 advance at right angles to their first sides 1W during travel in the units 3 and 4, and that the trays advance at right angles to their second sides 1N during travel into or from the wagon 6 as well as during travel with the upper reaches of the intermediate conveyors 32 and 32′.

The exact mode of operation of the apparatus depends on the relationship between the output of the maker FT and the requirements of the processing machine PM. It is now assumed that the processing machine PM is idle or that the advancement of cigarettes along the conveyor MFP between the tray filling unit 3 and the tray evacuating unit 4 of FIG. 9 is interrupted, that the tray filling unit 3 operates at full capacity, and that the tray evacuating unit 4 also operates at full capacity so that it can take up the output of the tray filling unit 3 for delivery into the mass flow on the conveyor MFP at a junction JC or for temporary storage in filled trays which gather on the lower conveyor 12A′. The unit 3 then receives cigarettes from the outlet of the maker FT or from the conveyor MFP at a diverting station DS and fills successive empty trays which are located on and form a row on the upper reach of the conveyor 12. The supply of empty trays on the conveyor 12 at the upper level 9 of the tray filling unit 3 is replenished by empty trays which arrive from the upper conveyor 12′ of the tray evacuating unit 4 via upper intermediate conveyor 12′ and turret 2. Thus, an empty tray which rests on the conveyor 12′ of the tray evacuating unit 4 is advanced from the position Eb to the position Ea (by the carriage 37 of FIG. 6*a*), such empty tray is then advanced by the conveyor 32 to the position C, the tray is inverted by one of the upper carriers 16 from the position C to the position B, and such tray is then moved from the position B to the position A, i.e., onto the conveyor 12 at the upper level 9 of the tray filling unit 3. Whenever the rotor 17 of the turret 2 is caused to change its angular position, it also inverts a filled tray which has been delivered from the position A (on the lower conveyor 12A of the unit 3) to the position B so that the filled tray then assumes the position C and is in the range of the lower intermediate conveyor 32′ for transfer to the position Ea whence the filled tray is moved to the position Eb by the mechanism of FIG. 6*b*, i.e., by the carriage 48. At the same time, the unit 4 evacuates the contents of successive filled trays 1 at the junction JC of FIG. 9 or simply stores the filled trays on its conveyor 12A′. The means for synchronizing the operation of the indexing motor 28 with the operation of other motors (such as the motors 19, 36, 47 and 53) is not specifically shown in the drawing.

Figure 1:
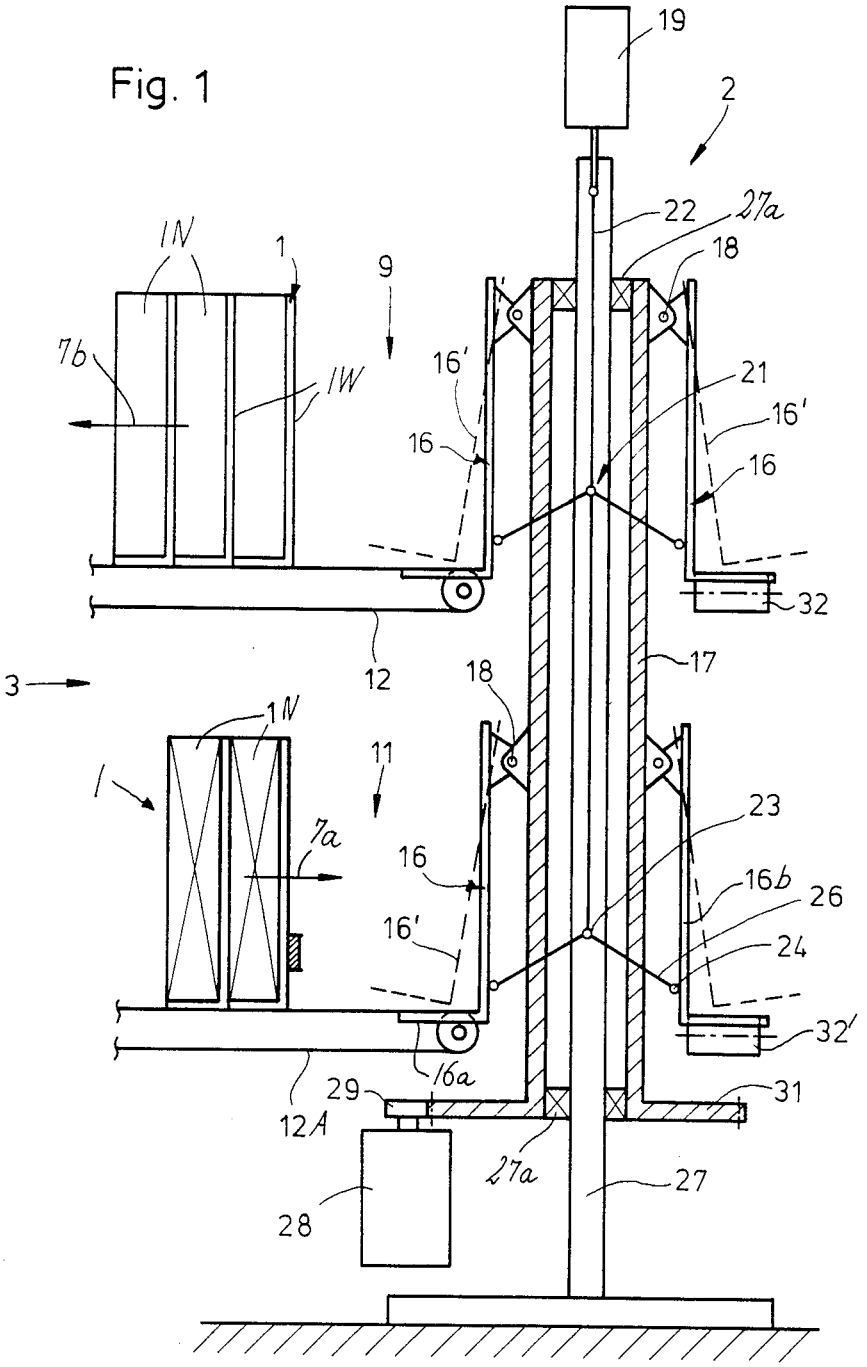
FIG. 1 is a fragmentary vertical sectional view of an apparatus which embodies one form of the invention, the section being taken in the direction of arrows as seen from the line I—I of FIG. 2.

When pneumatic motor 19 is actuated to move the piston rod 22 downwardly, as viewed in FIG. 1, the links 26 of the pivoting means 21 pivot relative to each other to increase the angles between the respective pairs of links 26 with the result that the carriers 16 assume the broken-line positions 16' of FIG. 1. The pivotal movements of carriers 16 from the solid-line positions to the broken-line positions 16' of FIG. 1 need not exceed 10 degrees; such angular displacements suffice to lift a freshly arrived empty tray off the upper conveyor 32 and to lift a freshly supplied filled tray off the lower conveyor 12A of the tray filling unit 3. The motor 28 is then started to index the rotor 17 through 180 degrees through the medium of the gears 29, 31. This moves the filled tray at the lower level 11B of the turret 2 from the position B to the position C while the empty tray at the upper level 9B of the turret 2 moves from the position C to the position B. The motor 19 is then actuated to return the carriers 16 to the solid-line positions of FIG. 1 so that the freshly inverted trays 1 reassume their upright positions or are moved to less pronouncedly inclined positions (e.g., from a 10-degree inclination to a 3-degree inclination). This causes the respective carriers 16 to deposit the turned empty tray 1 onto the upper conveyor 12 of the tray filling unit 3 and to deposit the turned filled tray onto the lower conveyor 32' for transport toward the tray evacuating unit 4. As mentioned above, the filled tray is then moved from the position Ea to the position Eb (i.e., from the lower intermediate conveyor 32' onto the lower conveyor 12A' of the tray evacuating unit 4, and the empty tray is moved from the position C to the position B, i.e., onto the upper conveyor 12 of the tray filling unit 3.

The transfer of a filled tray from the lower conveyor 32' into the tray evacuating unit 4 takes place in a manner as described in connection with FIG. 6*b*, i.e., the tray moves from the position E*a* to the position Eb by being entrained by the carriage 48. The empty tray 1 is filled in the tray filling unit 3 in a manner not forming part of the present invention, and the filled tray is emptied in the evacuating unit 4 also in a manner which forms no part of this invention.

In the event of a malfunctioning of the processing machine and of the evacuating unit 4, the apparatus operates as follows: A filled tray 1 is transferred from A to B in FIG. 2. Such filled tray is then lifted off the conveyor 12' at the lower level 11 of the tray filling unit 3 in the aforedescribed manner (by pivoting the carriers 16 from the solid-line positions to the broken-line positions 16' of FIG. 1). The motor 28 is then started to index the rotor 17 of the turret 2 through 90 (rather than 180) degrees, i.e., from the position B to the position D of FIG. 2. The filled tray remains in the position of inclination (approximately 10 degrees) resulting from retention of the corresponding carrier 16 in the position 16'. In such position, the tray is transferred onto the lower platform 14 of the wagon 6 by resorting to the mechanism of FIG. 4, i.e., the motor 53 is caused to move the piston rod 52 in a direction to the left, as viewed in FIG. 4, whereby the filled tray moves from the position D to the position F, i.e., from the pivoted carrier 16 of the turret 2 onto the lower platform 14 of the wagon 6. At the same time, an empty tray is transferred from the upper platform 13 of the wagon 6 onto the adjacent (inclined) carrier 16 of the upper pair of carriers on the rotor 17. Thus, such empty tray is shifted from F to D at the upper level 9A of the turret 2, and this transfer is effected by causing the jaws 57 of the corresponding transfer mechanism to engage the empty tray and to pull it from the position F to the position D at the upper level 9B of the turret 2. When the empty tray reaches the position D (shown in FIG. 4 by broken lines), the jaws 57 are disengaged because the respective followers 59 then track the corresponding lobes 62 so that the tray 1 comes to rest on the adjacent carrier 16 (in the position 16') and is ready to be transferred to the position B of FIG. 2 by indexing the rotor 17 through 90 degrees. This completes a cycle (transfer of a filled tray from the lower level 11 of the unit 3 onto the platform 14 of the wagon 6 and the transfer of an empty tray from the platform 13 of the wagon 6 to the upper level 9 of the tray filling unit 3), and the next cycle can begin.

In the event of failure of the maker FT, i.e., when the tray filling unit 3 fails to receive cigarettes from a cigarette making or filter tipping machine, an empty tray in the position Eb at the upper level 9E of the tray evacuating unit 4 is transferred to the position Ea to be accepted by the upper intermediate conveyor 32. The means for effecting such transfer is the mechanism of FIG. 6*a*. The empty tray 1 on the upper intermediate conveyor 32 is then transported in the direction of arrow *7f* to assume the position C of FIG. 2. The rotor 17 is then indexed through 90 degrees to move the empty tray from the position C to the position D. The mechanism of FIG. 4 thereupon causes the empty tray to leave its carrier 16 at the upper level 9B of the turret 2 and to enter the upper part of the wagon 6, i.e., to come to rest on the upper platform 13. At the same time, a filled tray is withdrawn from the platform 14 of the wagon 6 by the corresponding mechanism of the type shown in FIG. 4 so that the filled tray moves from the position F to the position D at the lower level 11B of the turret 2. Indexing of the rotor 17 through 90 degrees moves such filled tray from the position D to the position C so that the filled tray is entrained by the lower intermediate conveyor 32' and is moved to the position Ea preparatory to introduction into the tray evacuating unit 4 (from the position Ea onto the lower conveyor 12A' of the unit 4). If the malfunctioning of the maker FT persists, the same cycle is repeated again, i.e., an empty tray is transported from the position Eb at the upper level 9E of the unit 4 to the position Ea, such tray is then transported to the position C, turned to the position D and moved to the position F on the upper platform 13 of the wagon 6. Such movement of an empty tray takes place simultaneously with the movement of a filled tray from the lower platform 14 of the wagon 6 (position F) to the position D, thence to the position C, deposition on the lower intermediate conveyor 32', transfer to the position Ea and delivery to the position Eb on the lower conveyor 12A' of the unit 4. The latter delivers the contents of successive filled trays 1 to the conveyor MFP at the junction JC of FIG. 9.

If the processing machine PM is operated faster than the maker so that the output of the machine FT which is connected to the tray filling unit 3 must be supplemented by the contents of one or more trays on the platform 14 of the wagon 6, the operation is analogous to the previously described operations, i.e., the unit 4 then receives filled trays from the lower platform 14 of the wagon 6 via lower intermediate conveyor 32', and the mechanism of FIG. 6*b* delivers filled trays from the position Ea to the position Eb.

If the output of the maker FT exceeds the requirements of the processing machine PM, some of the filled trays are delivered onto the lower platform 14 of the wagon 6 and the remaining filled trays are transferred onto the lower conveyor 32' for transport to the tray evacuating unit 4.

Figure 7:
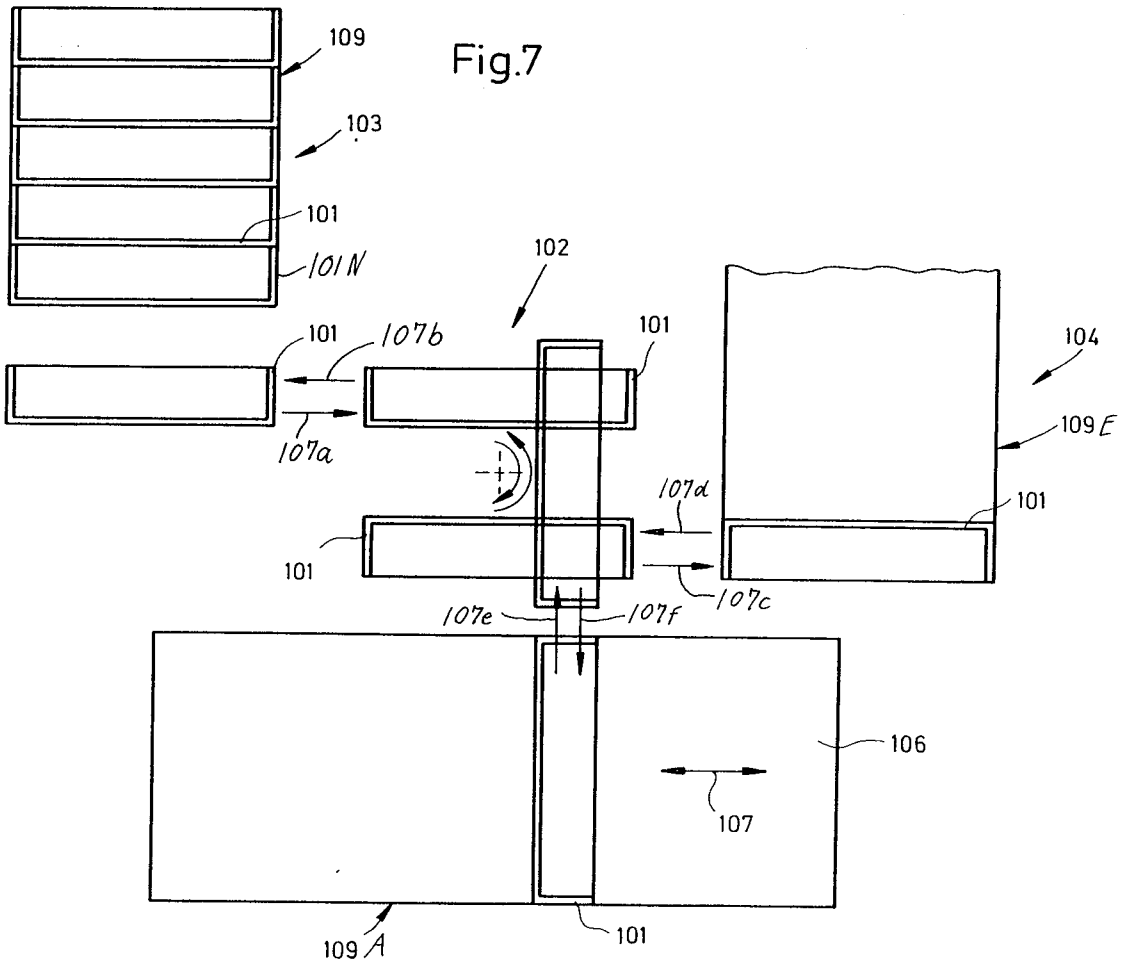
FIG. 7 is a schematic plan view of a second apparatus wherein the intermediate conveyors are omitted.

FIG. 7 shows a modified apparatus wherein all such parts which are identical with or clearly analogous to corresponding parts of the aforedescribed apparatus are denoted by similar reference characters plus 100. The main difference between this apparatus and the apparatus of FIGS. 1 to 6*b* is that the turret 102 is disposed directly between the tray filling unit 103 and the tray evacuating unit 104, i.e., the intermediate conveyors 32 and 32' can be dispensed with. Another difference is that, during travel toward or away from the turret 102, the trays 101 are invariably caused to move edgewise, i.e., at right angles to the axes of the articles which are stored therein and at right angles to the planes of their narrow sides 101N. This is indicated by the arrows 107*a*, 107*b*, 107*c*, 107*d*, 107*e* and 107*f*. Each tray 101 which is transferred from the unit 103 directly to the unit 104 or vice versa is turned through 180 degrees, and each tray 101 which is to be transferred from the unit 103 or 104 onto the wagon 106 or vice versa is turned through 90 degrees.

Figure 8:
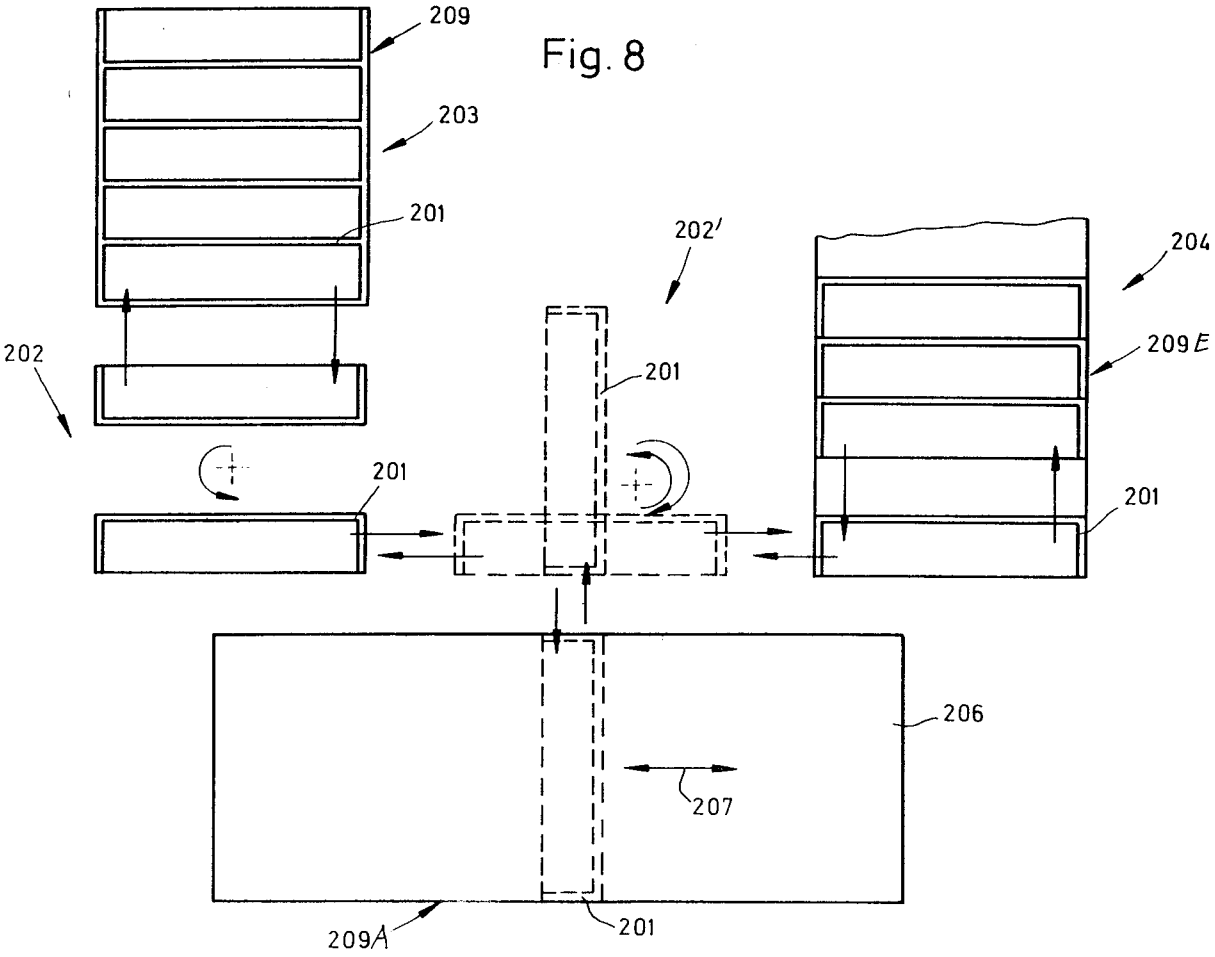
FIG. 8 is a plan view of a third apparatus which employs two indexible turrets.

All such parts of the apparatus of FIG. 8 which are identical with or clearly analogous to the corresponding parts of the apparatus of FIGS. 1 to 6*b* are denoted by similar reference characters plus 200. The connecting means of the apparatus of FIG. 8 comprises two indexible turrets 202 and 202'. The turret 202 cooperates directly with the tray filling unit 203 (i.e., it delivers empty trays 201 to and receives filled trays from the unit 203), and the turret 202' cooperates with the turret 202, with the wagon 206 and with the tray evacuating unit 204. In other words, the turret 202' can receive filled trays 201 from the unit 203 and/or from the wagon 206 for delivery to the unit 204 or to the wagon 206, and the turret 202' can receive empty trays 201 from the unit 204 or wagon 206 for delivery to the turret 202 or wagon 206. The turret 202 can be a replica of the turret 2 of FIG. 1, i.e., such turret can have two levels with a pair of carriers at each level. The carriers of each pair are angularly offset by 180 degrees with reference to each other. The turret 202' has a single carrier at each of the two levels.

When the rate at which the unit 203 fills trays 201 matches the rate at which the unit 204 evacuates the contents of or stores filled trays, the angular position of the rotor forming part of the turret 202' does not change at all, i.e., the turret 202' then performs the functions of the intermediate conveyors 32, 32' by transferring empty trays 201 from the upper level of the unit 204 to the upper level of the unit 203, and by transferring filled trays from the lower level of the unit 203 to the lower level of the unit 204. The turret 202' must be indexed at given intervals if the output of the tray filling unit 203 exceeds the requirements of the tray evacuating unit 204 or vice versa. The turret 202' then diverts the surplus of filled trays onto the lower platform of the wagon 206 or it diverts the surplus of empty trays onto the upper platform of the wagon 206. Such transfer of trays into or from the wagon 206 takes place by indexing the trays on the turret 202' through 90-degree angles.

The utilization of orientation changing devices in the form of one or more upright turrets contributes to compactness of the improved apparatus. The wagon constitutes an optional but highly advantageous and desirable feature of the improved apparatus because it can take up surplus empty trays and/or surplus filled trays when the requirements of the tray evacuating unit do not match the output of the tray filling unit. All that is necessary to employ such wagon is to provide the turret 2, 102 or 202' with a drive which can index the respective rotor through 90 or 270 degrees.

Pivotability of carriers 16 on the rotors of the respective turrets also constitutes an optional feature. However, such pivotability is desirable and advantageous because it renders it possible to dispense with additional transferring mechanisms. For example, and referring again to FIG. 1, the upper left-hand carrier can deposit a freshly inverted empty tray directly onto the conveyor 12 at the upper level 9, and the lower left-hand carrier 16 can pick up a filled tray 1 directly from the upper reach of the conveyor 12A at the lower level 11 of the transfer unit 3. All that is necessary is to provide means for pivoting the carriers 16 with reference to the rotor 17; this suffices to enable certain carriers to pick up trays and certain carriers to deposit trays without the need for any additional transferring mechanisms.

The wagon can be disposed at any one of a number of different locations without departing from the spirit of the invention. For example, and as shown in FIG. 2, the wagon 6 can be placed adjacent to the turret 2 and is movable in parallelism with the intermediate conveyors 32, 32', i.e., at right angles to the directions (arrows 7*a*, 7*b*, 7*c* and 7*d*) of movement of trays in the units 3 and 4. If the wagon 6 is placed to the left of the turret 2, as viewed in FIG. 2, the programming of the synchronizing mechanism for the various mobile parts is altered accordingly so that empty and filled trays can enter or leave the wagon by moving in the direction of arrow 7*e* or 7*f*.

An important advantage of the improved apparatus is that the orientation of cigarettes which advance from the maker FT to the processing machine PM of FIG. 9 by moving along the path which is defined by the mass flow conveyor MFP is the same as the orientation of cigarettes which are admitted to the mass flow at the junction JC, i.e., the orientation of cigarettes which are delivered by the trays of the evacuating unit 4, 104 or 204 is the same as the orientation of cigarettes entering the trays at the filling station 3, 103 or 203 because each filled tray is automatically caused to change its orientation by 180 degrees during transport from the tray filling unit to the tray evacuating unit so that the renewed change of orientation during evacuation of the contents of filled trays at or close to the junction JC restores the original orientation of each cigarette which has been diverted at DS. Moreover, the improved apparatus is surprisingly compact and it can be installed in existing production lines to replace heretofore known apparatus for temporary storage of surplus cigarettes or analogous rod-shaped articles of the tobacco processing industry. Still further, there is no need to manipulate filled or empty trays by hand so that the improved apparatus can be combined with or installed in production lines which employ modern high-speed making and processing machines.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for manipulating receptacles for rod-shaped articles of the tobacco processing industry, particularly for manipulating chargers for cigarettes, comprising a first multi-level unit for filling of the receptacles; a second multi-level unit for evacuating articles from filled receptacles, each of said units having means for storing receptacles at its respective levels; and means for connecting said units, comprising at least one orientation changing device which is rotatable about a predetermined substantially vertical axis and includes at least one carrier at each level of a unit, each of said carriers being arranged to removably support a receptacle and said carriers being indexible about said vertical axis so as to transport receptacles between several storing means of said first unit and the corresponding storing means of said second unit.

2. The apparatus of claim 1, wherein each of said units includes two levels.

3. The apparatus of claim 1, wherein said device includes a rotary turret.

4. The apparatus of claim 1, wherein said device includes pairs of carriers, one pair for each level of a unit, and the carriers of each pair are angularly offset by 180° with reference to one another.

5. The apparatus of claim 1, wherein each of said units includes an upper level and a lower level, each of said storing means including a first platform disposed at said upper level and arranged to support empty receptacles, and a second platform disposed at said lower level and arranged to support filled receptacles.

6. The apparatus of claim 5, wherein said platforms include endless conveyors.

7. The apparatus of claim 1, wherein said device comprises an upright rotor and means for pivotally mounting said carriers on said rotor.

8. The apparatus of claim 7, wherein said mounting means defines for said carriers substantially horizontal axes which are disposed substantially tangentially of said rotor.

9. The apparatus of claim 7, wherein said device further comprises an upright column rotatably supporting said rotor, and means for pivoting said carriers with reference to said rotor.

10. The apparatus of claim 9, wherein said pivoting means comprises a linkage for each of said carriers and means for moving said linkages with reference to said column.

11. The apparatus of claim 1 for manipulating receptacles of the type having a pair of relatively wide substantially upright first sides and a pair of relatively narrow substantially upright second sides, further comprising a mobile magazine adjacent to said device, means for transferring receptacles between one of said units and said device by moving the receptacles at right angles to said first sides, means for transferring receptacles between said magazine and said device by moving the receptacles at right angles to said second sides, and means for transferring receptacles between said device and the other of said units by moving the receptacles at right angles to said second sides.

12. The apparatus of claim 1 for manipulating receptacles of the type having a pair of relatively wide substantially upright first sides and a pair of relatively narrow substantially upright second sides, and further comprising a mobile magazine adjacent to said device, and means for transferring receptacles between said device on the one hand and said units and said magazine on the other hand by moving the receptacles at right angles to said second sides.

13. The apparatus of claim 12, wherein said device is disposed between said units.

14. The apparatus of claim 1, wherein said device is adjacent to one of said units and includes a pair of carriers for each level of a unit, said connecting means further comprising a second orientation changing device interposed between said first mentioned device and the other of said units, said second device having a single carrier for each level of a unit.

15. The apparatus of claim 14, further comprising a mobile multi-level magazine adjacent to said second device.

16. The apparatus of claim 1, wherein said carriers are indexible about said vertical axis so as to simultaneously transport receptacles between several storing means of said first unit and the corresponding storing means of said second unit.

17. Apparatus for manipulating receptacles for rod-shaped articles of the tobacco processing industry, particularly for manipulating chargers for cigarettes, comprisng a first multi-level unit for filling of the receptacles; a second multi-level unit for evacuating articles from filled receptacles; and means for connecting said units, comprising at least one orientation changing device which is rotatable about a predetermined substantially vertical axis and includes at least one carrier at each level of a unit, each of said carriers being arranged to removably support a receptacle and said carriers being indexible about said vertical axis, said device further including means for indexing said carriers about said vertical axis through angles of n times 90° wherein n is a whole number including one.

18. Apparatus for manipulating receptacles for rod-shaped articles of the tobacco processing industry, particularly for manipulating chargers for cigarettes, comprising a first multi-level unit for filling of the receptacles; a second multi-level unit for evacuating articles from filled receptacles; means for connecting said units, comprising at least one orientation changing device which is rotatable about a predetermined substantially vertical axis and includes at least one carrier at each level of a unit, each of said carriers being arranged to removably support a receptacle and said carriers being indexible about said vertical axis; a mobile magazine adjacent to said device; and means for transferring receptacles between said magazine and said device.

19. The apparatus of claim 15, further comprising means for moving said magazine with reference to said device stepwise through increments of predetermined length so as to provide room for transfer of successive receptacles between said device and said magazine.

20. The apparatus of claim 19, wherein said magazine includes a wheel-mounted conveyance.

21. Apparatus for manipulating receptacles for rod-shaped articles of the tobacco processing industry, particularly for manipulating chargers for cigarettes, comprising a first multi-level unit for filling of the receptacles; a second multi-level unit for evacuating articles from filled receptacles; means for connecting said units, comprising at least one orientation changing device which is rotatable about a predetermined substantially vertical axis and includes at least one carrier at each level of a unit, each of said carriers being arranged to removably support a receptacle and said carriers being indexible about said vertical axis; and means for indexing said carriers through angles of 90°.

22. Apparatus for manipulating receptacles for rod-shaped articles of the tobacco processing industry, particularly for manipulating chargers for cigarettes, comprising a first multi-level unit for filling of the receptacles; a second multi-level unit for evacuating articles from filled receptacles, each of said units including an upper and a lower level, a first platform disposed at said upper level and arranged to support empty receptacles, and a second platform disposed at said lower level and arranged to support filled receptacles; means for connecting said units, comprising at least one orientation changing device which is rotatable about a predetermined substantially vertical axis and includes at least one carrier at each level of a unit, each of said carriers being arranged to removably support a receptacle and said carriers being indexible about said vertical axis; a mobile magazine adjacent to said device and having an upper platform for temporary storage of empty receptacles and a lower platform for temporary storage of filled receptacles; and means for transferring empty and filled receptacles between the platforms of said device and the respective platforms of said magazine.

23. Apparatus for manipulating receptacles for rod-shaped articles of the tobacco processing industry, particularly for manipulating chargers for cigarettes, comprising a first multi-level unit for filling of the receptacles; a second multi-level unit for evacuating articles from filled receptacles; means for connecting said units, comprising at least one orientation changing device which is rotatable about a predetermined substantially vertical axis and includes at least one carrier at each level of a unit, each of said carriers being arranged to removably support a receptacle and said carriers being indexible about said vertical axis; a mobile magazine adjacent to said device and arranged to exchange receptacles with said device at each of said levels, said magazine comprising means for temporarily storing receptacles in a first orientation and said units including means for storing receptacles in a different second orientation; and means for transferring receptacles between said device and said magazine at each of said levels.

24. Apparatus for manipulating receptacles for rod-shaped articles of the tobacco processing industry, particularly for manipulating chargers for cigarettes, comprising a first multi-level unit for filling of the receptacles; a second multi-level unit for evacuating articles from filled receptacles, each of said units including means for supporting receptacles at each of the respective levels in a first orientation and for movement in a predetermined direction; means for connecting said units, comprising at least one orientation changing device which is rotatable about a predetermined substantially vertical axis and includes at least one carrier at each level of a unit, each of said carriers being arranged to removably support a receptacle and said carriers being indexible about said vertical axis; a mobile multi-storey magazine adjacent to said device and including means for storing receptacles in a different second orientation at each of said levels; and means for transferring receptacles between said device and each storey of said magazine.

25. The apparatus of claim 24, further comprising means for mounting said magazine for movement at right angles to said predetermined direction.

* * * * *